US008085968B2

(12) United States Patent
Silver

(10) Patent No.: US 8,085,968 B2
(45) Date of Patent: Dec. 27, 2011

(54) RESONATING CONE TRANSDUCER

(75) Inventor: Jason D. Silver, Framingham, MA (US)

(73) Assignee: Bose Corporation, Framingham, MA (US)

( * ) Notice: Subject to any disclaimer, the term of this patent is extended or adjusted under 35 U.S.C. 154(b) by 831 days.

(21) Appl. No.: 12/174,768

(22) Filed: Jul. 17, 2008

(65) Prior Publication Data

US 2010/0014702 A1 Jan. 21, 2010

(51) Int. Cl.
*H04R 1/00* (2006.01)

(52) U.S. Cl. ..... 381/398; 381/403; 381/423; 181/171

(58) Field of Classification Search ..... 381/398, 381/403–404, 423–424; 181/171–173
See application file for complete search history.

(56) References Cited

U.S. PATENT DOCUMENTS

| | | | | |
|---|---|---|---|---|
| 3,727,719 | A | 4/1973 | Yando | |
| 4,146,756 | A | 3/1979 | Kito et al. | |
| 4,387,275 | A | 6/1983 | Shimada et al. | |
| 4,595,801 | A | 6/1986 | Coffin | |
| 4,829,581 | A | 5/1989 | Nieuwendijk et al. | |
| 4,837,839 | A | 6/1989 | Andrews | |
| 4,847,908 | A | 7/1989 | Nieuwendijk et al. | |
| 5,528,697 | A | 6/1996 | Saito et al. | |
| 6,343,128 | B1 | 1/2002 | Coffin | |
| 6,466,676 | B2 | 10/2002 | Coffin | |
| 7,324,658 | B2 * | 1/2008 | Kobayashi | 381/396 |
| 2005/0111673 | A1 | 5/2005 | Rosen et al. | |
| 2005/0244030 | A1 * | 11/2005 | Takayama et al. | 381/404 |
| 2008/0013780 | A1 * | 1/2008 | Kobayashi et al. | 381/398 |
| 2008/0240488 | A1 * | 10/2008 | Funahashi et al. | 381/423 |
| 2010/0208934 | A1 * | 8/2010 | Dohi et al. | 381/398 |

FOREIGN PATENT DOCUMENTS

| | | |
|---|---|---|
| JP | 58-133098 | 8/1983 |

* cited by examiner

*Primary Examiner* — Richard A. Booth

(57) ABSTRACT

An electroacoustical transducer includes a bobbin, a first acoustic radiator coupled to the bobbin through a first surround having a mechanical compliance, a second acoustic radiator generally rigidly coupled to the bobbin, and a basket. The first acoustic radiator is coupled to the basket through a second surround, and the second acoustic radiator is coupled to the basket through a third surround. The first surround is constructed to cause the first acoustic radiator to move out of phase with the second acoustic radiator relative to the bobbin when actuated by the bobbin at acoustic frequencies at and above a resonant frequency of the first acoustic radiator.

20 Claims, 7 Drawing Sheets

RESONATING CONE TRANSDUCER

BACKGROUND

This disclosure relates to a resonating cone transducer.

Electroacoustical transducers typically have a single radiating surface, called a cone, that is moved by a linear actuator to cause movement of air and thereby produce sounds. One or more electroacoustical transducers are generally assembled in a housing or mounted to a panel, such as a wall or an automobile door panel, to produce a loudspeaker.

SUMMARY

In general, in one aspect, an electroacoustical transducer includes a bobbin, a first acoustic radiator coupled to the bobbin through a first surround having a mechanical compliance, a second acoustic radiator generally rigidly coupled to the bobbin, and a basket. The first acoustic radiator is coupled to the basket through a second surround, and the second acoustic radiator is coupled to the basket through a third surround. The first surround is constructed to cause the first acoustic radiator to move out of phase with the second acoustic radiator relative to the bobbin when actuated by the bobbin at acoustic frequencies at and greater than a resonant frequency of the first acoustic radiator.

Implementations may include one or more of the following features. A spider couples the bobbin to the basket. The basket is configured to route radiated acoustic energy from the second acoustic radiator to combine with radiated acoustic energy from the first acoustic radiator in a listening area. The basket includes openings between an inner wall and an outer wall through which the radiated acoustic energy from the second acoustic radiator is routed to the listening area. The basket includes supports creating an opening between an outer wall and a motor structure through which the radiated acoustic energy from the second acoustic radiator is routed to the bobbin, the bobbin being hollow and routing the radiated acoustic energy to the listening area. The basket includes an inner wall coupled to the second and third surrounds to define a first volume bounded by the first acoustic radiator, second acoustic radiator, an outer surface of the bobbin, the inner wall of the basket, and the first, second, and third surrounds, and an outer wall surrounding the inner wall to form a second volume bounded by the second acoustic radiator, the third surround, and the outer wall of the basket, the outer wall and the inner wall defining a passage venting the second volume to a third volume outside the basket. The passage vents the second volume to the third volume proximate to an outer surface of the first acoustic radiator. A second passage vents the first volume to a fourth volume outside the basket, the fourth volume separated from the third volume by a baffle coupled to the basket. The basket includes a wall coupled to the second and third surrounds to define a first volume bounded by the first acoustic radiator, second acoustic radiator, an outer surface of the bobbin, the wall of the basket, and the first, second, and third surrounds, and a base that defines a second volume bounded by the second acoustic radiator, third surround, and the base, but open to an interior volume of the bobbin, the interior volume of the bobbin being open to a third volume outside the basket and bounded in part by the first acoustic radiator. The first acoustic radiator moves out of phase with the second acoustic radiator relative to the bobbin when actuated by the bobbin at frequencies above about 40 Hz. The first acoustic radiator moves in phase with the second acoustic radiator relative to the bobbin when actuated by the bobbin at frequencies below about 40 Hz. The compliance of the first surround is such that the first surround couples low-acoustic-frequency oscillations of the bobbin to the first acoustic radiator and attenuates transmission of high-acoustic-frequency oscillations of the bobbin to the first acoustic radiator. The first surround attenuates transmission of oscillations of the bobbin to the first acoustic radiator at frequencies above about 55 Hz such that the first acoustic radiator has a velocity with a magnitude less than a magnitude of a velocity of the bobbin. A dust cap coupled to the bobbin through a compliant joint. The compliant joint includes a shear joint. The compliant joint includes a fourth surround.

In general, in one aspect, a basket supports components of an electroacoustical transducer including a bobbin, a linear actuator, a first acoustic radiator, and a second acoustic radiator. The basket includes an inner wall supporting outer edges of the first and second acoustic radiators. The first acoustic radiator faces a first, open volume. An outer wall forms a second, enclosed volume bounded by the outer wall and the second acoustic radiator, and a passage between the inner wall and the outer wall vents the second volume to the first volume. In some examples, the inner wall also supports a spider.

In general, in one aspect, an electroacoustical transducer includes a bobbin, a first acoustic radiator coupled to the bobbin through a first surround having a first mechanical compliance, a first mass, and a second surround having a second mechanical compliance, a second mass generally rigidly coupled to the bobbin, and a basket. The first acoustic radiator is coupled to the basket through a third surround. The first and second surrounds and the first and second masses are constructed to cause the first acoustic radiator to move in phase with the bobbin when actuated by the bobbin at acoustic frequencies below a first frequency, out of phase with the bobbin when actuated by the bobbin at acoustic frequencies between the first frequency and a second frequency higher than the first frequency, and in phase with the bobbin when actuated by the bobbin at acoustic frequencies above the second frequency. In some examples, the second mass is a second acoustic radiator.

Advantages include producing the same sound pressure and low frequencies as traditional loudspeakers having larger overall enclosed transducer volume, and producing greater sound pressure at lower frequencies than traditional speakers having the same overall transducer volume.

Other features and advantages will be apparent from the description and the claims.

DESCRIPTION

FIGS. 1A, 2, 3, 4, 5A, and 6 show cross-sectional views of electroacoustical transducers.

To increase the acoustic energy output of an electroacoustical transducer at a given frequency, the radiating surface can be made larger or it can be made to travel farther. Either solution typically results in a larger overall transducer assembly, especially in a transducer designed to reproduce low-frequency sounds. As described below, to increase low-frequency acoustic energy output without making the transducer larger, or to maintain low-frequency acoustic energy output while making the transducer smaller, two radiating surfaces are used. In addition, one of the radiating surfaces is configured to resonate at low frequencies, extending the range over which the transducer efficiently operates. By low-frequency, we mean frequencies in the lower bounds of typical human hearing, generally those below about 100 Hz. The techniques described here are also applicable to mid-frequency speakers, generally those reproducing frequencies between 65 Hz and 3 kHz.

Figure 1A:
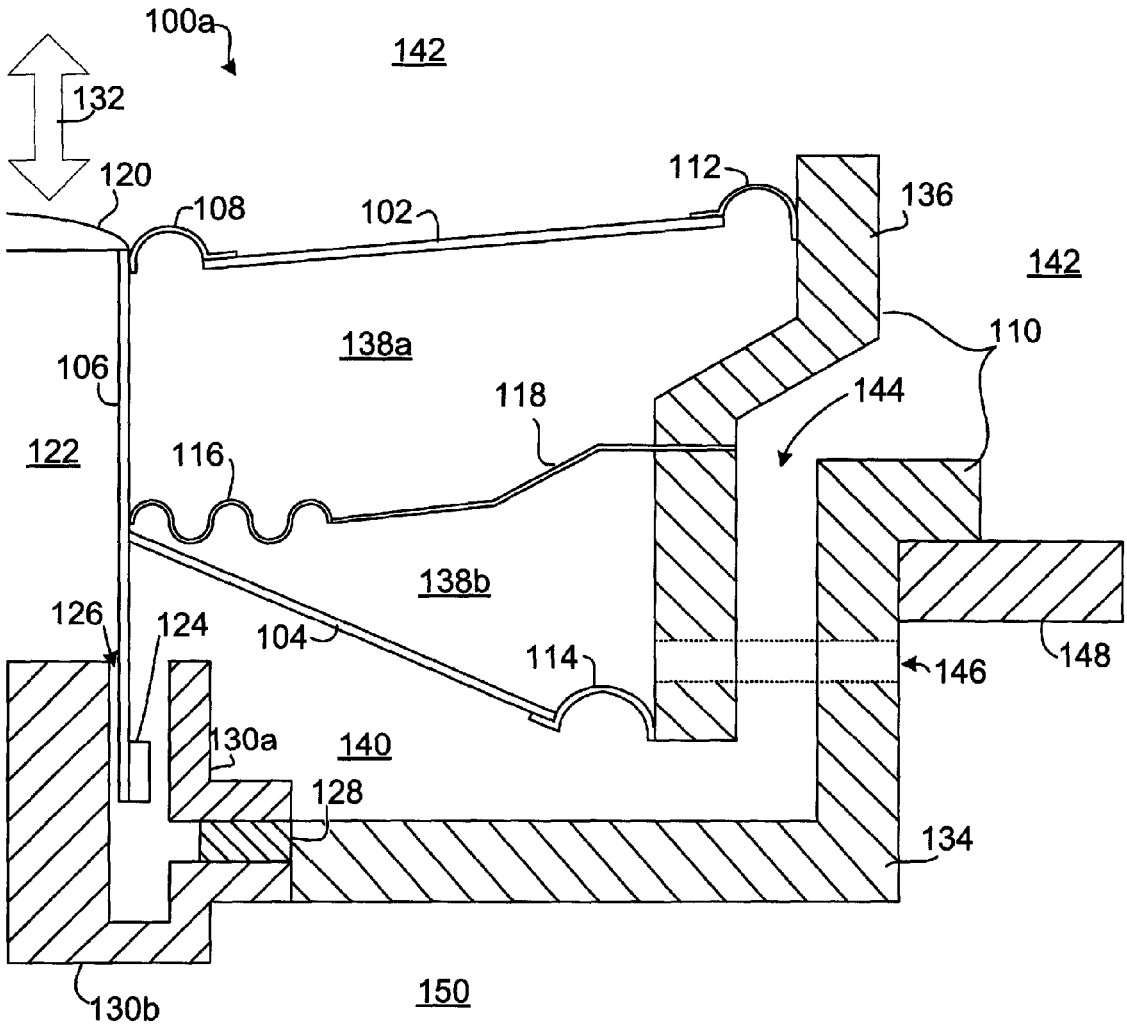
FIG. 1B shows a perspective cross-sectional view of the electroacoustical transducer of FIG. 1A.
Figure 1B:
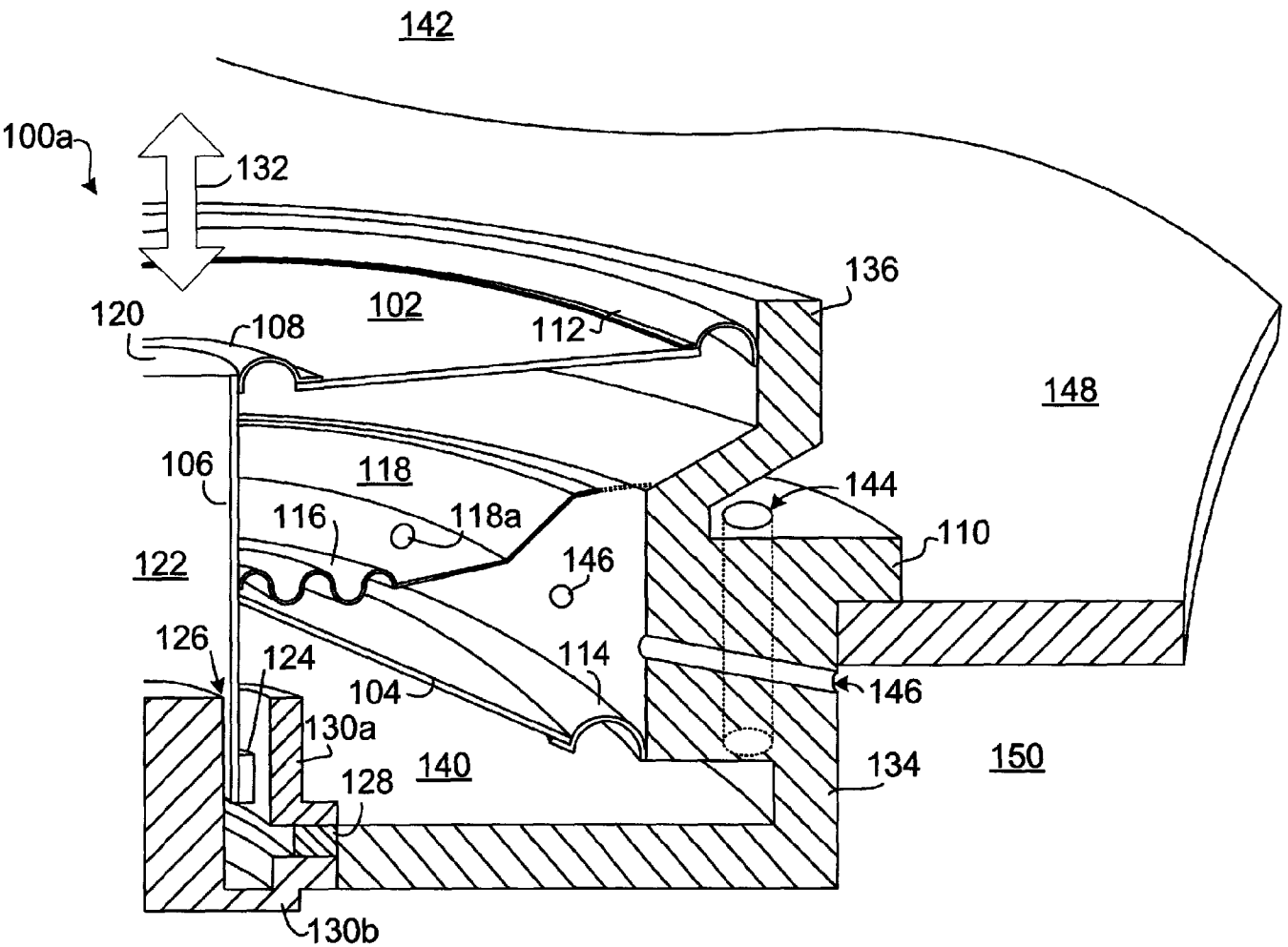

As shown in FIGS. 1A and 1B, an electroacoustical transducer 100*a* includes two speaker cones 102 and 104 coupled to a bobbin 106. By "cone," we refer to the principal radiating surfaces of an acoustical transducer (driven or passive), sometimes called a diaphragm. A "cone" does not necessarily have a conical shape in any given embodiment. In the example of FIGS. 1A and 1B, the front cone 102 is coupled to the bobbin 106 through a first surround 108. The rear cone 104 is coupled to the bobbin 106 directly through adhesive or any other suitable method of attachment that provides a relatively rigid coupling, as in a typical electroacoustical transducer. The front cone 102 is coupled to a basket 110 through a second surround 112, and the rear cone is coupled to the basket 110 through a third surround 114. The bobbin is also coupled to the basket 110, through a spider 116 and spider support 118. The top of the bobbin is covered by a dust cap 120, forming a dust cap volume 122 inside the bobbin. A voice coil 124 is wound around the base of the bobbin. The voice coil 124 is positioned in a groove 126 between a front plate 130*a* and a pole piece 130*b* that sandwich an annular magnet 128. The voice coil, magnet, front plate and pole piece form the linear actuator that moves the bobbin and cones. The pole piece 130*b*, or the part of it that sandwiches the magnet with the front plate, is sometimes also called the back plate. The bobbin 106 is sometimes called a voice coil former.

When an electric current oscillating at an acoustic frequency is applied to the voice coil 124, electromagnetic forces between the voice coil and the magnet 128 cause the voice coil and bobbin to move linearly, in the direction shown by arrow 132. Linear motion of the voice coil causes the cones, surrounds, and dust cap to move, producing acoustic radiation. Physical properties of the moving parts, including their size, weight, and flexibility, as well as their arrangement and the arrangement of the non-moving parts, determine the amount of power that is output by the transducer at any given frequency and input current. One measure of the power output of a transducer is sound pressure level, SPL, measured at a given distance from the transducer.

In some examples, the compliance of the first surround 108 efficiently couples motion of the bobbin 106 to the front cone 102 at low frequencies. The compliance of the first surround 108, however, allows the front cone to resonate when driven at its resonant frequency, rather than to move in lock-step with the bobbin 106, increasing output at the front cone's resonant frequency. In some examples, when near its resonant frequency, the magnitude of the front cone's velocity is greater than that of the bobbin and rear cone. At higher frequencies, the surround 108 blocks the coupling of bobbin motion to the cone (i.e., it attenuates transmission of mechanical energy from the bobbin to the cone) so little energy is passed on to the front cone 102. The velocity of the front cone begins to decrease above its resonant frequency. In one example, the resonant frequency is about 40 Hz, around which the front cone moves faster than the bobbin and rear cone. In this example, the front cone's velocity is equal to that of the bobbin and rear cone at about 55 Hz, and is so low that the front cone's contribution to acoustic output is negligible by about 80 Hz. Because the rear cone 104 is directly coupled to the bobbin 106, it will radiate acoustic energy at both high and low frequencies when the bobbin is moving. In addition, due to the arrangement of the parts, the front cone and rear cone will move in opposite directions, i.e., out of phase with each other, at frequencies above the resonant frequency of the front cone. That is, the surround 108 introduces a delay between the bobbin and the front cone, so as the bobbin and rear cone move up, the front cone is still moving down (or, initially, not moving); as the bobbin and rear cone reach their maximum excursion and begin moving down, the front cone reaches its lowest position and begins moving up. This balanced motion decreases the net mechanical vibration imparted to the basket 110 and surrounding structures from motion of the cones. At still lower frequencies, i.e., below its resonant frequency, the front cone 102 moves in-phase with the bobbin and rear cone 104.

In some examples, to provide the acoustic radiation from both the rear cone and front cone to the listening area, the basket is configured to route the sound (communicated through the air) from the rear side of the transducer to the front. In the example of FIGS. 1A and 1B, the basket has an outer wall 134 and an inner wall 136. The second and third surrounds are attached to the inner wall, forming inner volumes 138*a*, 138*b* between the cones, inner wall, and bobbin. The outer wall and rear cone form a rear volume 140, which is coupled to the listening area 142 through a passage 144 between the inner and outer wall. As the front cone and rear cone move in opposite directions, the acoustic pressure the front cone produces directly in the listening area will be in phase with the acoustic pressure the rear cone produces in the rear volume. At low frequencies, where the wavelength of sound is significantly longer than the distance from the rear volume to the listening area, acoustic pressure from the rear volume delivered to the listening area through the passage 144 will remain effectively in phase with the acoustic pressure from the front cone, and the pressures from the two cones will be combined, i.e., they will constructively interfere, in the listening area 142. At high frequencies, only the rear cone radiates significant acoustic energy, which is again communicated through the passage 144 to the listening area 142. In some examples, the passage 144 surrounds most of the periphery of the basket, interrupted by supports holding the inner wall 136 in position. In some examples, as in FIG. 1B, the passage 144 is implemented as a series of holes or tubes through an otherwise solid basket structure 110 (only one tube is shown in FIG. 1B). The number and size of holes is selected to provide sufficient air flow to efficiently couple the rear volume 140 to the listening area 142 without creating a back pressure (or to control the amount of back pressure to a desired level) in the rear volume 140. In some examples, the number of tubes is such that about 50% of the space between the inner and outer walls is open.

In some examples, the transducer 100*a* is mounted in a baffle 148, such as a automobile door panel or a wall of a room. The inner volumes 138*a*, 138*b* are coupled together through a vent 118*a* in the spider support 118 and in turn are coupled through a passage 146 to the open space 150 behind the baffle 148, effectively removing pressure within the inner volumes from consideration. In some examples, where the inner wall 136 and outer wall 134 are generally separate parts separated by the passage 144, the passage 146 is implemented as a tube passing through the walls and passage 144. In some examples, where the basket is generally solid and the passage 144 is a series of tubes or holes, the passage 146 may also be a series of tubes through the basket structure, with the tubes positioned to avoid intersecting the tubes or holes 144. In some examples, the back side of the basket may be exposed to water, and passage 146 includes a valve or a membrane, such as a layer of Gore-Tex® fabric from W.L. Gore & Associates, Inc., of Elkton, Md., to avoid passing water into the inner volumes 138*a*, 138*b* while allowing air to flow.

From around the resonant frequency of the front cone to the frequency where front cone radiation is negligible, about 40 Hz to about 80 Hz in some examples, the sound pressure waves from the two cones add constructively in the listening area 148, and effectively act as a single cone of larger area. Thus, at low frequencies, the power of a larger cone can be delivered in the area required by the total diameter of the rear cone 104 plus the width of the passage 144 without requiring an increase in voice coil excursion. The freedom of the front cone to resonate further increases efficiency around the resonant frequency. For a given package size, this design means greater low-frequency power can be provided than a traditional transducer without an increase in voice coil excursion. For a desired low-frequency power, this design requires less voice coil excursion than a transducer having the same diameter. Decreasing (or at least not increasing) voice coil excursion is important because it relates directly to the total package depth of the transducer. To support such efficiencies, the passages 144 and 146 allow sufficient air flow between their respectively coupled volumes to prevent pressure from building up in the rear or inner volumes and opposing motion of the cones. In some examples, either or both of the passages 144 and 146 are structured as bass reflex ports, changing the acoustic behavior of the transducer 100*a*.

In the example of FIGS. 1A and 1B, the spider support 118 is a disk extending from the inner wall 136 of the basket to the spider 116 and includes openings 118*a* to allow air to freely flow between the top and bottom areas of the inner volume. In some examples, the spider support is a series of arms with open space in between. In other examples, the spider support is solid or the spider extends to the basket, in which case the top 138*a* and bottom 138*b* halves of the inner volume are each ported to the outside, as shown by passages 146*a* and 146*b* in FIG. 2. In the example transducer 100*b* of FIG. 2, more of the basket 110 is recessed behind the baffle, allowing both of the passages 146*a* and 146*b* to vent to the space 150 behind the baffle. In some examples, also show in FIG. 2, vents 152 in the bobbin allow air to flow between the inner volume and the dust cap volume. In some examples, the presence of the vents 152 requires the passage 146*a* to include a valve or membrane to block water from the space 150 from reaching the interior volumes and in turn the passage 144 into the listening area.

In some examples, one or both of the surrounds 108 and 112 are damped. The amount of damping controls the quality "Q" of the resonant frequency response of the front cone 102. The stiffness of the surrounds 108 and 112 relative to the mass of the cone 102 determines the cut-off frequency at which bobbin motion is absorbed by the first surround 108 and not coupled to the front cone. In some examples, the surround 112 is at least three times lower in stiffness than the surround 108, providing for efficient operation of the transducer resulting from a broad resonant response of the front cone. The damping from the surround 108 in that case is set as low or lower than is needed for a flat frequency response in the far field.

Figure 2:
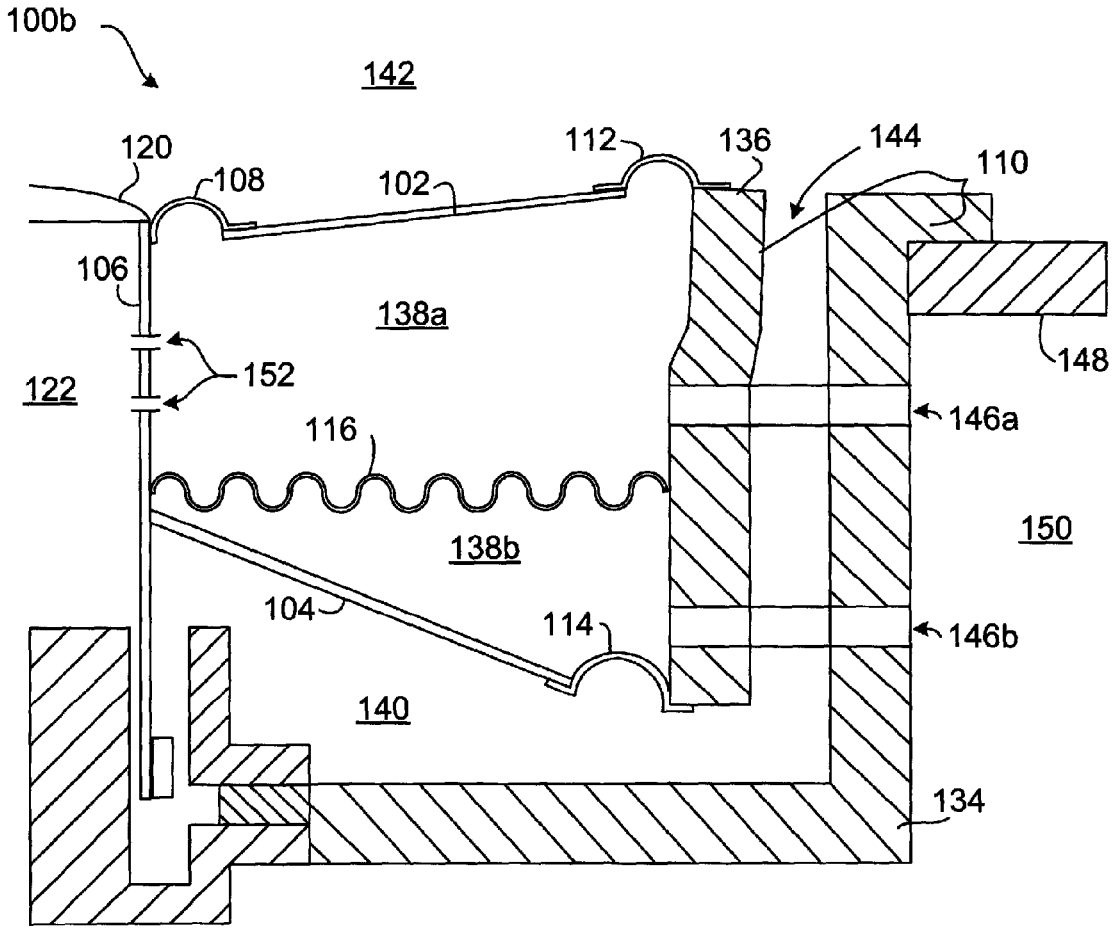

In the example of FIGS. 1A and 1B, the surrounds 108 and 112 are attached to the bobbin and basket 110 using a vertical attachment. As shown, the material of the surround extends vertically past the point where the curved portion (referred to as the "roll") reaches the bobbin or basket, providing mating surface area in contact with the side wall of the bobbin or basket without a second corner in the material. In some examples, the surround 114 is also attached in this way. In another example, as shown in FIG. 2, the second and third surrounds 112 and 114 have a more traditional shape in which the material bends back to match the plane of the top or bottom surface of the basket. In either version, the surrounds may be attached to the bobbin or basket and to the cones using adhesive or they may be molded in place, with the material of the surround bonding directly to the other parts, such as through insert molding, with or without a primer coating on the bonded parts. The rear cone 104 and spider 116 are attached to the bobbin using any standard approach used in typical electroacoustical transducers.

The spider 116 and spider support 118 provide the bobbin 106 with stability against rocking, to avoid the voice coil 124 colliding with the front plate 130*a* or pole piece 130*b*. Preventing rocking allows a smaller groove 126, which in turn provides for more efficient conversion of electrical input power to acoustical output power, and thus, a more efficient transducer. In some examples, the compliance of the surrounds and stiffness of the cones is such that the cones and surrounds prevent the bobbin from rocking and the spider is omitted.

Figure 3:
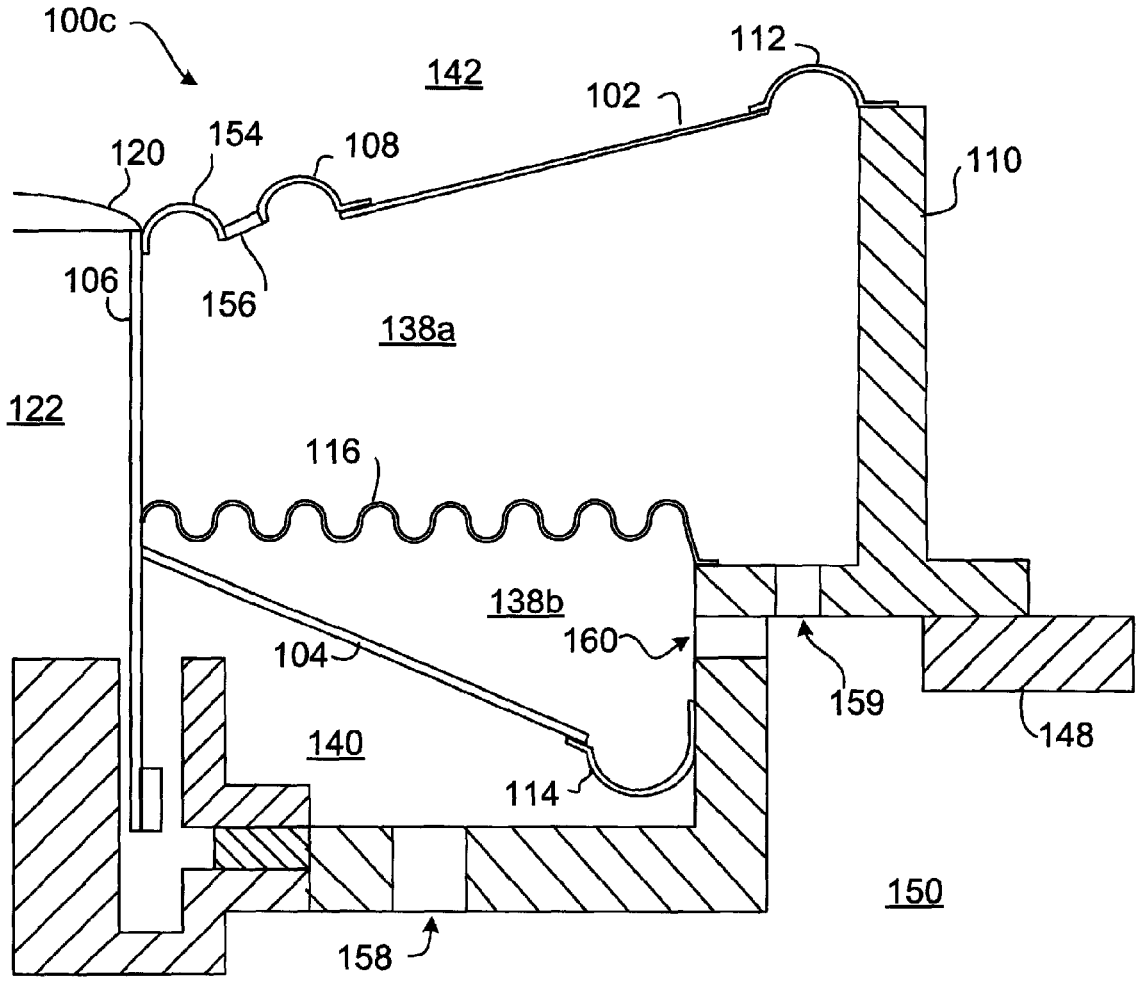

Another embodiment 100*c* is shown in FIG. 3. In this example, a fourth surround 154 and a mass 156 are added between the first surround 108 and the bobbin 106. The mass is sized to avoid creating an additional radiating surface, typically less than 10% the area of the front cone 102. The third surround 114 is inverted relative to its position in the other examples. In the example of FIG. 3, the upper inner volume 138*a*, the lower inner volume 138*b*, and the rear volume 140 are vented to the space 150 behind the baffle 148 through vents 158, 159, and 160. In some examples, the spider 116 is sufficiently porous that the vent 159 can be omitted. In the transducer 100*c*, three different resonant modes occur, improving performance at higher frequencies or extending the operating range of the transducer and decreasing dips in the far field pressure. A first resonant mode occurs when all the parts move together, at very low frequencies. A second resonant mode occurs in intermediate frequencies when the front cone 102 moves out of phase with the bobbin, 106, rear cone 104, and the mass 156. A third resonant mode, not present in the examples of FIGS. 1A, 1B, and 2, occurs at higher frequencies when the front cone 102, bobbin 106, and rear cone 104 again move together while the mass 156 moves out of phase with the cones. In this mode, the front cone radiates sound pressure at frequencies where it would have been silent in the other examples. In this embodiment, the rear cone does not radiate acoustic pressure that reaches the listening area. In some examples, the rear cone serves to provide mass needed for tuning the resonant frequencies and stiffness to help prevent rocking of the bobbin. In some examples, these functions are provided by masses or stabilizing structures that do not necessarily function as acoustic radiators.

Figure 4:
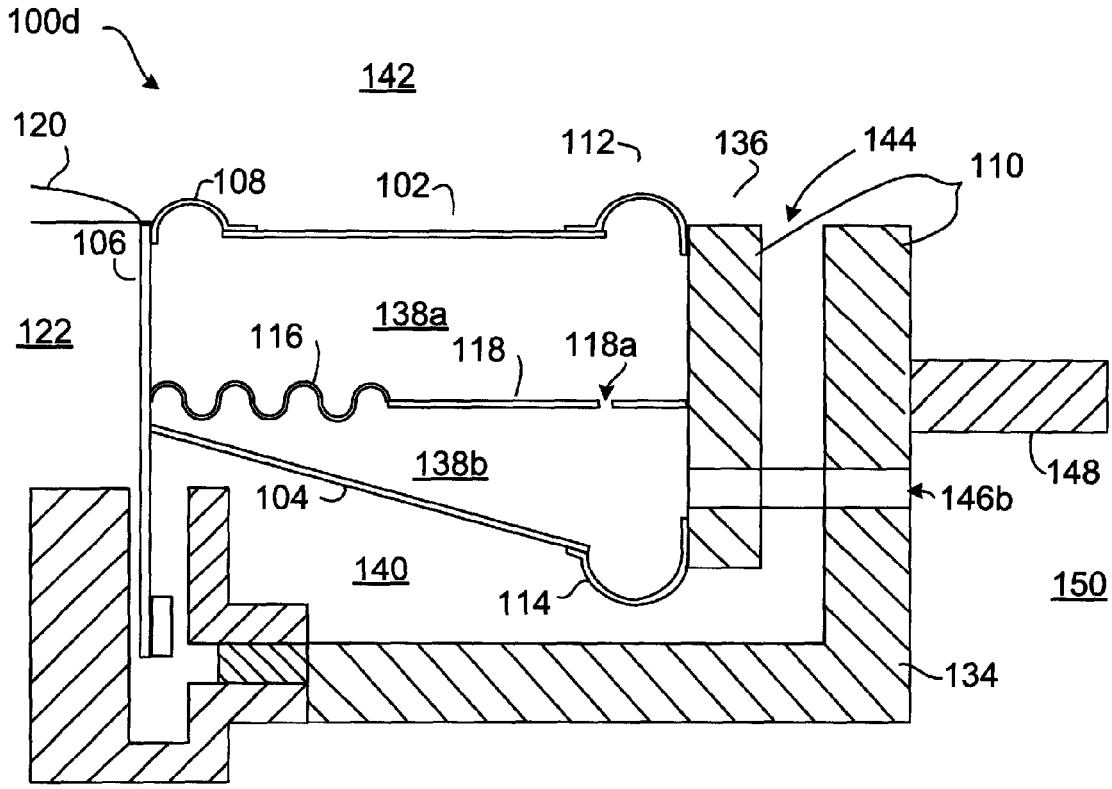

In some examples, as shown by transducer 100*d* in FIG. 4, the front cone 102 is flat, which allows lower overall height and provides greater clearance between the front cone and the spider. Each of these variations may be selected as needed to provide the particular acoustic properties needed for a given transducer.

Figure 5A:
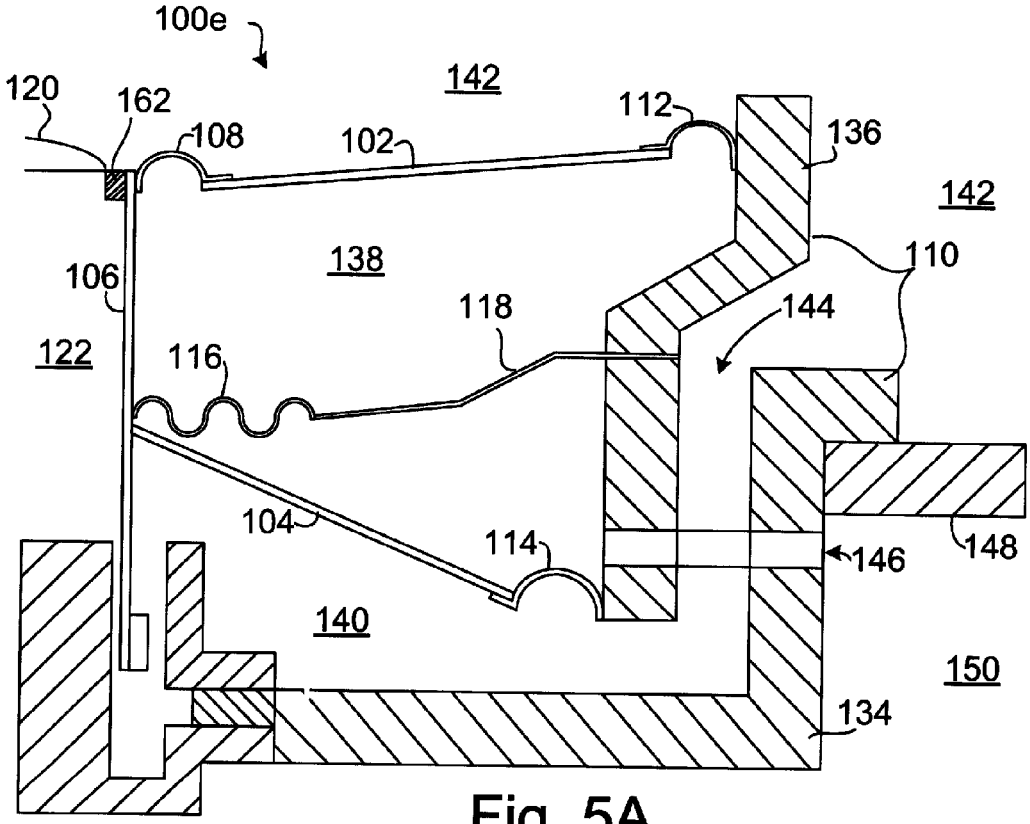
FIGS. 5B and 5C show cross-sectional views of joints within electroacoustical transducers.
Figure 5B:
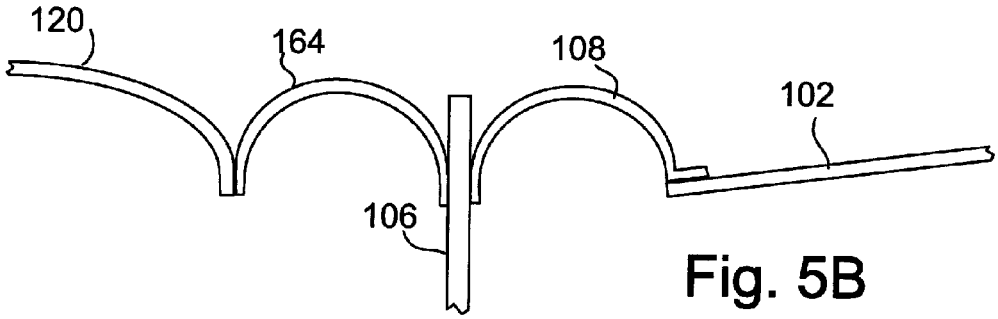
Figure 5C:
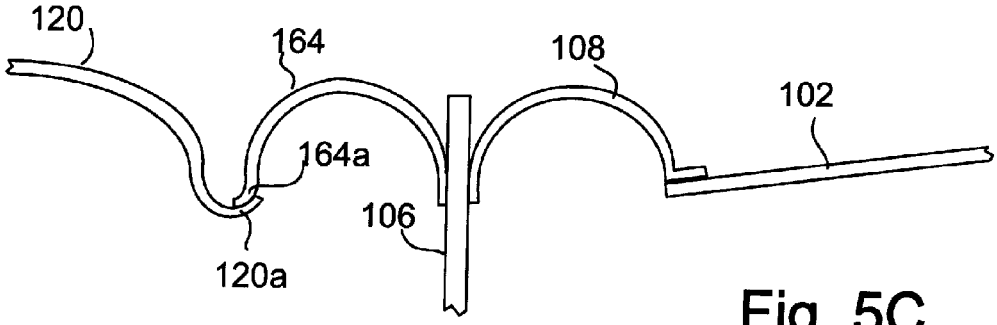

In some examples, as shown by transducer 100*e* in FIGS. 5A through 5C, the dust cap is connected to the bobbin through a joint with some compliance. In the example of FIG. 5A, which is otherwise the same as transducer 100*a* of FIG. 1A, the dust cap 120 is connected to the bobbin 106 through a shear joint 162. This joint can be some deformable material, such as a solid or foam silicone rubber or polyurethane with viscoelastic properties. Such a joint can be modeled as a spring in combination with a dahspot. The shear joint 162 decouples motion of the dust cap 120 from the bobbin 106 at the highest frequencies of operation, i.e., frequencies above where the first surround 108 starts attenuating transmission of energy from the bobbin to the front cone 102. This decoupling causes the dust cap to move out of phase with the bobbin and resonate, boosting the pressure sensitivity and efficiency of the transducer at high frequencies. Low damping in the shear joint 162 provides for a broad dust cap resonance, covering as much of the high frequency spectrum as possible, and also gives the resonance a high-enough quality to increase the pressure response of the transducer at high frequencies. Because the front cone 102 is not moving at these frequencies, it does not interfere with sound radiated from the resonating dust cap. Like the added mass in the example of FIG. 3, the resonating dust cap can improve the high frequency performance of the transducer and it can increase the range of frequencies at which the transducer can operate. Although shown with the example of FIG. 1A, the shear joint 162 can be used in other embodiments as well.

FIGS. 5B and 5C illustrate two other joints between the dust cap 120 and the bobbin 106. As with the shear joint, these examples can be used with any of the other arrangements of cones and surrounds. In the example of FIG. 5B, a surround 164 with low damping is used to connect the dust cap 120 to the bobbin 106. In the example of FIG. 5C, the dust cap 120 and surround 164 include flanges 120*a*, 164*a* at their joint. Which of these configurations to use may depend on performance criteria, manufacturing capabilities, part cost, or other such factors.

Figure 6:
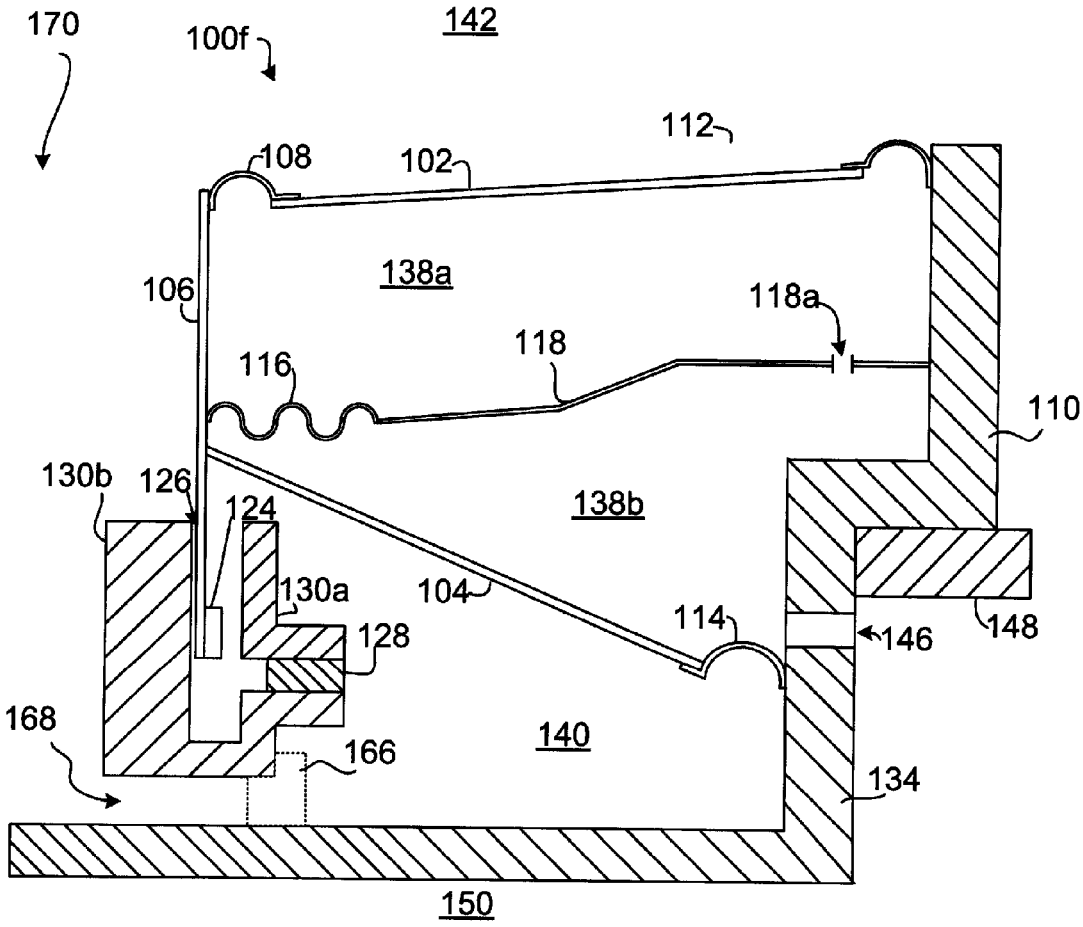

Another embodiment is shown in FIG. 6. In this transducer 100*f*, the magnet 128, front plate 130*a*, and pole piece 130*b* are raised to be fully within the basket 110, with a spacer 166 maintaining their separation. The spacer 166 leaves a passage 168 between the pole piece 130*b* and the bottom of the outer wall 134 of the basket 110. In some examples, the spacer is a set of posts, leaving space in-between for the passage 168. Three or more posts will prevent rocking of the magnet, front plate, and pole piece assembly. Also in this example, the dust cap is omitted, leaving an opening 170 at the top of the bobbin. Air pressure from the back volume 140 flows through the passage 168 under the pole piece and out to the listening area 142 through the opening 170. The cross-sectional area of the passage 168 and opening 170 are selected to keep the maximum flow velocity below a level where the flow noise and non-linear behavior of the transducer would occur. In some examples, this limit is 10 m/s.

This construction allows passage 144 and inner wall 136 to be omitted, giving the basket 110 a simpler overall structure and potentially allowing more flexibility in how the transducer is packaged into the vehicle or other location. Vent 118*a* operates as in FIG. 1A to allow air to pass between the interior volumes 138*a*, 138*b*, but the passage 146 is simplified and can simply be a series of openings in the outer wall 134 of the basket 110, as it is not necessary to segregate that passage from the omitted passage 144.

Other implementations are within the scope of the following claims and other claims to which the applicant may be entitled. For example, the figures used show a transducer package based roughly on a 6.5" low-to mid-frequency loudspeaker manufactured by Bose Corporation of Framingham, Mass., for use in car door panels. Similar cone designs may be used in any suitable loudspeaker in which it is desired to achieve increased low-frequency power output within existing loudspeaker dimensions or to maintain low-frequency power output while decreasing loudspeaker dimensions.

What is claimed is:

1. An electroacoustical transducer comprising:

a bobbin;

a first acoustic radiator coupled to the bobbin through a first surround having a mechanical compliance;

a second acoustic radiator generally rigidly coupled to the bobbin; and a basket, the first acoustic radiator coupled to the basket through a second surround, and the second acoustic radiator coupled to the basket through a third surround, the first surround constructed to cause the first acoustic radiator to move out of phase with the second acoustic radiator relative to the bobbin when actuated by the bobbin at acoustic frequencies at and greater than a resonant frequency of the first acoustic radiator.

2. The transducer of claim 1 further comprising:

a spider coupling the bobbin to the basket.

3. The transducer of claim 1 in which the basket is configured to route radiated acoustic energy from the second acoustic radiator to combine with radiated acoustic energy from the first acoustic radiator in a listening area.

4. The transducer of claim 3 in which the basket includes openings between an inner wall and an outer wall through which the radiated acoustic energy from the second acoustic radiator is routed to the listening area.

5. The transducer of claim 3 in which the basket includes supports creating an opening between an outer wall and a motor structure through which the radiated acoustic energy from the second acoustic radiator is routed to the bobbin, the bobbin being hollow and routing the radiated acoustic energy to the listening area.

6. The transducer of claim 1 in which the basket comprises:

an inner wall coupled to the second and third surrounds to define a first volume bounded by the first acoustic radiator, second acoustic radiator, an outer surface of the bobbin, the inner wall of the basket, and the first, second, and third surrounds; and an outer wall surrounding the inner wall to form a second volume bounded by the second acoustic radiator, the third surround, and the outer wall of the basket, the outer wall and the inner wall defining a passage venting the second volume to a third volume outside the basket.

7. The transducer of claim 6 in which the passage vents the second volume to the third volume proximate to an outer surface of the first acoustic radiator.

8. The transducer of claim 6 in which a second passage vents the first volume to a fourth volume outside the basket, the fourth volume separated from the third volume by a baffle coupled to the basket.

9. The transducer of claim 1 in which the basket comprises a wall coupled to the second and third surrounds to define a first volume bounded by the first acoustic radiator, second acoustic radiator, an outer surface of the bobbin, the wall of the basket, and the first, second, and third surrounds; and a base that defines a second volume bounded by the second acoustic radiator, third surround, and the base, but open to an interior volume of the bobbin, the interior volume of the bobbin being open to a third volume outside the basket and bounded in part by the first acoustic radiator.

10. The transducer of claim 1 in which the first acoustic radiator moves out of phase with the second acoustic radiator relative to the bobbin when actuated by the bobbin at frequencies above about 40 Hz.

11. The transducer of claim 10 in which the first acoustic radiator moves in phase with the second acoustic radiator relative to the bobbin when actuated by the bobbin at frequencies below about 40 Hz.

12. The transducer of claim 1 in which the compliance of the first surround is such that the first surround couples low-acoustic-frequency oscillations of the bobbin to the first acoustic radiator and attenuates transmission of high-acoustic-frequency oscillations of the bobbin to the first acoustic radiator.

13. The transducer of claim 11 in which the first surround attenuates transmission of oscillations of the bobbin to the first acoustic radiator at frequencies above about 55 Hz such that the first acoustic radiator has a velocity with a magnitude less than a magnitude of the velocity of the bobbin.

14. The transducer of claim 1 further comprising a dust cap coupled to the bobbin through a compliant joint.

15. The transducer of claim 14 in which the compliant joint comprises a shear joint.

16. The transducer of claim 14 in which the compliant joint comprises a fourth surround.

17. An apparatus comprising:

a basket for supporting components of an electroacoustical transducer including a bobbin, a linear actuator, a first acoustic radiator, and a second acoustic radiator, the basket including:

an inner wall supporting outer edges of the first and second acoustic radiators, the first acoustic radiator facing a first, open volume an outer wall forming a second, enclosed volume bounded by the outer wall and the second acoustic radiator, and a passage between the inner wall and the outer wall venting the second volume to the first volume.

18. The apparatus of claim 17 in which the inner wall also supports a spider.

19. An electroacoustical transducer comprising:

a bobbin;

a first acoustic radiator coupled to the bobbin through a first surround having a first mechanical compliance, a first mass, and a second surround having a second mechanical compliance;

a second mass generally rigidly coupled to the bobbin; and a basket, the first acoustic radiator coupled to the basket through a third surround, the first and second surrounds and the first and second masses constructed to cause the first acoustic radiator to move in phase with the bobbin when actuated by the bobbin at acoustic frequencies below a first frequency, out of phase with the bobbin when actuated by the bobbin at acoustic frequencies between the first frequency and a second frequency higher than the first frequency, and in phase with the bobbin when actuated by the bobbin at acoustic frequencies above the second frequency.

20. The transducer of claim 19 in which the second mass is a second acoustic radiator.

* * * * *